United States Patent [19]

Glatthorn

[11] Patent Number: 4,576,228

[45] Date of Patent: Mar. 18, 1986

[54] MINIMUM WEAR TUBE SUPPORT HOLE DESIGN

[75] Inventor: Raymond H. Glatthorn, St. Petersburg, Fla.

[73] Assignee: The United States of America as represented by the United States Department of Energy, Washington, D.C.

[21] Appl. No.: 576,679

[22] Filed: Feb. 3, 1984

[51] Int. Cl.[4] ..... F28F 1/00; F28D 7/00

[52] U.S. Cl. ..... 165/162; 165/172; 165/178

[58] Field of Search ..... 165/162, 172, 178

[56] References Cited

U.S. PATENT DOCUMENTS

| | | | |
|---|---|---|---|
| 2,317,514 | 4/1943 | Bonnafe | 409/244 |
| 2,334,855 | 11/1943 | Zinkil | 425/459 |
| 2,805,049 | 9/1957 | Katholi | 165/159 |
| 3,176,762 | 4/1965 | Greenwood et al. | 165/162 |
| 3,559,730 | 2/1971 | Denjean | 165/178 |
| 3,589,438 | 6/1971 | Boorman | 165/172 |
| 3,804,354 | 4/1974 | Weiss | 165/162 |
| 4,056,441 | 11/1977 | Marmonier et al. | 165/162 |
| 4,120,350 | 10/1978 | Norton | 165/162 |
| 4,156,299 | 5/1979 | Kovac | 165/178 |
| 4,160,477 | 7/1979 | Roffler | 165/162 |
| 4,191,246 | 3/1980 | Cassell | 165/162 |
| 4,204,305 | 5/1980 | Norton | 29/157.4 |
| 4,285,396 | 8/1981 | Schwoerer et al. | 165/162 |
| 4,433,721 | 2/1984 | Biaggi | 165/162 |

FOREIGN PATENT DOCUMENTS

| | | | |
|---|---|---|---|
| 1814297 | 3/1970 | Fed. Rep. of Germany | 165/162 |

*Primary Examiner*—William R. Cline
*Assistant Examiner*—John J. McGlew, Jr.
*Attorney, Agent, or Firm*—Daniel C. Abeles

[57] ABSTRACT

A minimum-wear through-bore (16) is defined within a heat exchanger tube support plate (14) so as to have an hourglass configuration as determined by means of a constant radiused surface curvature (18) as defined by means of an external radius (R3), wherein the surface (18) extends between the upper surface (20) and lower surface (22) of the tube support plate (14). When a heat exchange tube (12) is disposed within the tube support plate (14) so as to pass through the through-bore (16), the heat exchange tube (12) is always in contact with a smoothly curved or radiused portion of the through-bore surface (16) whereby unacceptably excessive wear upon the heat exchange tube (12), as normally developed by means of sharp edges, lands, ridges, or the like conventionally part of the tube support plates, is eliminated or substantially reduced.

19 Claims, 1 Drawing Figure

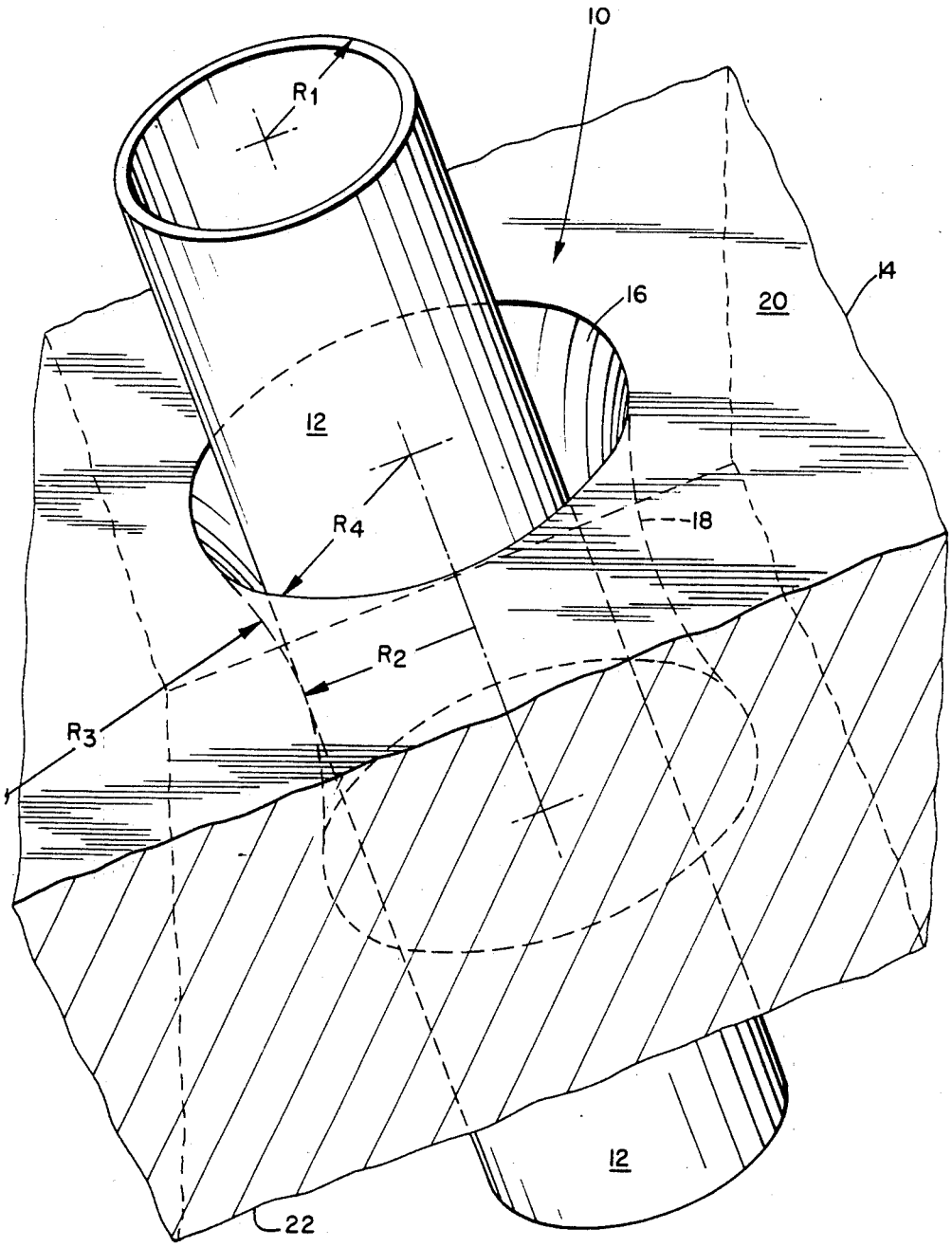
10
R1
14
16
20
12
R4
18
R2
R3
12
22

MINIMUM WEAR TUBE SUPPORT HOLE DESIGN

STATEMENT OF GOVERNMENT INTEREST

The present invention was either first conceived or reduced to practice under a contract with the U.S. Government, Contract No. DE-AC02-77ET-37201.

BACKGROUND OF THE INVENTION

1. Field of the Invention

The present invention relates generally to heat exchangers, and more particularly to a new and improved aperture, through-bore, or hole design or configuration which is to be defined within each tube support plate of a liquid metal-cooled fast breeder nuclear reactor (LMFBR) steam generator heat exchanger so as to be capable of supporting each of the steam generator heat exchange tubes relative to each of the tube support plates in such a manner that deleterious wear effects upon each of the heat exchange tubes, as a result of relative movement defined between each one of the heat exchange tubes and any one of the tube support plates, is minimized.

2. Description of the Prior Art

A nuclear reactor produces heat as a result of the fission of nuclear material which is disposed within fuel rods, the fuel rods being secured together so as to define fuel assemblies. The fuel assemblies define the nuclear reactor core, and the core is disposed within a reactor or pressure vessel. In commercial nuclear reactor facilities, the heat produced by means of the fission processes is utilized to generate electricity. In particular, conventional facilities usually comprise one or more primary flow and heat transfer or exchange loops, and a corresponding number of secondary flow and heat transfer or exchange loops to which conventional steam generators and steam turbines, as well as electrical generators, are fluidically and mechanically connected, respectively. A typical energy conversion process for such commercial nuclear reactor facilities would therefore comprise the transfer of heat from the nuclear core to the primary coolant flow and loop system, from the primary coolant flow and loop system to the secondary coolant flow and loop system by means of suitable heat exchangers, and finally from the secondary coolant flow and loop system to the steam generators by means of further suitable heat exchangers. The generated steam is then of course transmitted to the steam turbines to which the electrical generators are operatively connected, and from which electricity is ultimately generated.

In a liquid metal-cooled fast breeder reactor, liquid sodium serves as the reactor coolant and is therefore circulated through the primary coolant flow and loop system which typically comprises the nuclear core, a heat exchanger, and a circulating pump. In nuclear reactors having more than one primary coolant flow loop within the primary coolant flow system, the nuclear core and the reactor pressure vessel, within which the nuclear core is disposed, are connected in common to each of the primary coolant flow loops. The heat generated by means of the nuclear core is thus removed therefrom by means of the reactor coolant which is conducted into the reactor vessel and through the reactor core. The heated reactor coolant then exits from the nuclear core and the reactor vessel so as to flow through the heat exchangers which serve to transfer the heat to the secondary flow system loops operatively associated therewith. Liquid sodium is likewise disposed within the secondary flow system loops, and, in turn, the heated sodium disposed within the secondary flow system loops passes through suitable heat exchangers so as to transfer its heat to the water being conducted through the steam generators whereby steam is generated for use within the steam turbines. The steam turbines are then of course utilized to drive the electric generators for generating electricity. The cooled reactor core sodium coolant disposed within the primary flow loop system is of course recirculated back to the reactor pressure vessel and the reactor core by means of the primary flow loop system circulating pump, the secondary sodium coolant is likewise recirculated by means of its recirculating pump, and the coolant cycles are repeated. An intermediate or secondary coolant loop system is acknowledged to be mandatory within a liquid metal-cooled fast breeder reactor in view of the fact that liquid sodium exhibits explosive instability in the presence of water. Consequently, should any leakage develop between the sodium and water flow loops or paths, it is imperative to, in effect, isolate the reactor core from any deleterious effects attendant the violent or explosive mixing of the sodium and water components. In addition, the sodium disposed within the primary coolant flow loop system becomes radioactive after having been conducted through the reactor core, whereas the sodium coolant disposed within the closed secondary flow loop system is not radioactive. Consequently, should any leakage develop within the primary coolant loop system, the secondary coolant loop system effectively serves as a buffer zone to maintain radioactive coolant out of the steam generator water and steam, and prevent contamination of the steam turbines and the electric generator equipment.

Within one type of conventional, exemplary heat exchanger system defined between the intermediate or secondary non-radioactive liquid sodium coolant loop and the steam generator tubes through which water is conducted for the generation of steam, the water-steam generator tubes extend substantially vertically within the heat exchanger with the upper and lower ends of the tubes fixedly secured within upper or top, and lower or bottom, tubesheets, respectively. Suitable headers or manifolds fluidically surround the ends of the tubes and encase the tubesheets so as to supply water to, for example, the lower ends of the tubes and extract steam from the upper ends of the tubes. The liquid sodium enters the upper end of the heat exchanger at an elevational level below the upper or top tubesheet, and relatively cooled liquid sodium leaves the heat exchanger at an elevational level above the lower tubesheet. Consequently, the initially hot liquid sodium and initially cold water flow in opposite directions through the heat exchanger whereby the heat exchange process is conducted therebetween. In order to substantially restrain excessive lateral movements of the water-steam tubes within the heat exchanger under the influence of the downwardly flowing liquid sodium, which may exhibit cross-current flow paths or the like, or to substantially confine lateral movements of the water-steam tubes under any vibrational conditions which may manifest themselves, a plurality of vertically spaced tube support plates are fixedly suspended within the heat exchanger at positions intermediate the upper and lower tubesheets. The tube support plates are suspended in a stacked array from the upper or top tubesheet by means of a plurality of stay rods interposed between, and fixedly secured to, each tube support plate, and the entire array freely hangs downwardly from the upper or top tubesheet and is not fixed to the lower or bottom tubesheet. The water-steam tubes therefore pass through suitable apertures defined within the tube support plates such that the tubes are not fixedly secured to the tube support plates. Additional apertures are also provided within the tube support plates so as to permit the liquid sodium to pass therethrough, the liquid sodium also passing through the annular spaces defined between the water-steam tubes and the sidewalls of the apertures of the tube support plates through which the water-steam tubes pass, whereby the liquid sodium can traverse the vertical extent of the heat exchanger in furtherance of performance of its heat exchange function.

Within the aforenoted type of heat exchanger system, an operational deficiency has developed to the effect that excessive wear, and therefore a premature service life, of the water-steam tubes has manifested itself. The reason that such unacceptably excessive wear problems develop is due to the fact that during normal reactor operation, there is considerable movement of the water-steam tubes relative to the tube support plates, as well as considerable movement of the tube support plates relative to the water-steam tubes. For example, during start-up or transient operational conditions, the water-steam tubes may experience substantial vibrational loads which may cause movement of the same relative to the tube support plates. Cross-currents of the liquid sodium flowing through the heat exchanger may likewise cause transverse movement or buckling loads to be impressed upon the water-steam tubes thereby likewise causing movement of the same relative to the tube support plates. Such relative transverse movement of the water-steam tubes with respect to the tube support plates causes abrasive wear to be developed between the water-steam tubes and the sidewalls of the tube support plate apertures through which the water-steam tubes pass. Alternatively, during the start-up period of the power plant facility, the tube support plates and their stay rods are relatively cool and are at the same temperature as the water-steam tubes. However, as the plant or facility becomes operational, the tube support plates and their stay rods become very hot due to the fact that the heated liquid sodium is in direct contact therewith throughout the heat exchanger. To the contrary, the water-steam tubes will not experience a similar elevation in temperature level due to the fact that cold water is being initially circulated within the tubes and a change of state from water to steam absorbs a substantial amount of the heat energy through means of the heat exchange process. Consequently, the tube support plates, and particularly the stay rods thereof supporting the same, will experience substantial thermal growth whereby the tube support plates will in fact exhibit considerable movement relative to the water-steam tubes. In a similar manner, transient operating conditions may also result in variable thermal conditions prevailing within the heat exchanger whereby thermal expansion or contraction of the tube support plates and their stay rods may again be manifested. For example, should a pump failure occur within the liquid sodium coolant loop circulating system, the heated liquid sodium will be stagnantly disposed within the loop and the heat exchanger while the relatively cooler water will continue to be conducted through the water-steam tubes. A relative increase in the temperature level of the sodium will therefore be experienced relative to the water-steam tubes, and consequently, it follows that the tube support plates and the stay rods will likewise experience an elevation in temperature and thermal growth. Upon rectification of the circulating pump malfunction, steady-state operations will again prevail whereby the temperature level of the liquid sodium will be somewhat lowered whereby the tube support plates and stay rods would experience some thermal contraction relative to the water-steam tubes. All of such relative movements result in unacceptably excessive wear of the water-steam tubes whereby the same have to be replaced more frequently than would normally be expected or desired.

In order to alleviate the foregoing problems, it has been attempted to re-design the sidewalls of the tube support plate apertures through which the water-steam tubes pass so as to minimize the aforenoted excessive wear problems. In lieu of conventional, straight through-bores defined within the tube support plates whereby when the water-steam tubes become angularly oriented with respect to the tube support plates due to the aforenoted relative movements of either the tubes or the tube support plates with respect to each other, or simply when the tubes are in contact with the tube support plate aperture sidewalls due to eccentric alignment defined therebetween, excessive wear of the tubes was experienced due to abrasion developed between the tubes and the upper or lower annular edges of the tube apertures defined within the tube support plates, one attempt sought to provide such upper and lower aperture annular edges with rounded or chamfered edge surfaces. In accordance with another prior art attempt at resolving the aforenoted abrasion problems, the upper and lower regions of the through-bores or apertures were actually provided with conically-configured tapered surfaces which met at a central land portion. As may be surmised, however, despite both attempts at such a resolution of the problem, the problem persisted in view of the fact that the tubes nevertheless had to ride over or traverse the central land region which, in itself, presented a substantial edge portion about which the tubes would be bent and abraded. A still further, third type of attempt to resolve the aforenoted problem consisted in providing the interior sidewall portions of the tube support plate apertures with radially inwardly extending cusp-shaped projections upon which the tubes may be supported either by means of lineal or point contact surfaces. Nevertheless, such an attempted resolution to the problem also failed to in fact resolve the problem, for again, sharp-edged surfaces were present which still generated a considerable amount of abrasion upon the exterior sidewalls of the water-steam tubes.

Accordingly, it is an object of the present invention to provide a new and improved aperture, through-bore, or hole design or configuration within a tube support plate of a heat exchanger through which a water-steam tube of a steam generator is adapted to be disposed.

Another object of the present invention is to provide a new and improved aperture, through-bore, or hole design or configuration within a tube support plate of a nuclear reactor steam generator heat exchanger through which a water-steam tube is adapted to be disposed.

Yet another object of the present invention is to provide a new and improved aperture, through-bore, or hole design or configuration within a tube support plate of a nuclear reactor steam generator heat exchanger through which a water-steam tube is adapted to be disposed, wherein the various operational disadvantages and drawbacks of conventional tube support plate apertures or through-bores will be overcome.

Still another object of the present invention is to provide a new and improved aperture, through-bore, or hole design or configuration within a tube support plate of a nuclear reactor steam generator heat exchanger through which a water-steam tube is adapted to be disposed, wherein unacceptably excessive wear upon the water-steam tube due to relative movement defined between the water-steam tube and the tube support plate will be effectively eliminated or minimized.

Yet still another object of the present invention is to provide a new and improved aperture, through-bore, or hole design or configuration within a tube support plate of a nuclear reactor steam generator heat exchanger through which a water-steam tube is adapted to be disposed, wherein the particular design or configuration of the aperture, through-bore, or hole is such as to readily lend itself to substantially simplified production or fabrication.

Still yet another object of the present invention is to provide a new and improved aperture, through-bore, or hole design or configuration within a tube support plate of a nuclear reactor steam generator heat exchanger through which a water-steam tube is adapted to be disposed, wherein such aperture, through-bore, or hole design or configuration serves to substantially extend the service life of the water-steam tubes within the heat exchanger.

SUMMARY OF THE INVENTION

The foregoing and other objectives are achieved in accordance with the present invention through the provision of a nuclear reactor steam generator heat exchanger tube support plate having defined therein a plurality of apertures, through-bores, holes, or the like, for accommodating the disposition therethrough of water-steam tubes, wherein each of the apertures, through-bores, holes, or the like, is defined by means of an annular sidewall which has a smoothly radiused curvature extending from the upper surface of the tube support plate to the lower surface of the tube support plate. In particular, the inner diametrical extent of each aperture, through-bore, hole, or the like, continuously varies from the upper tube support plate surface to the lower tube support plate surface in such a manner that the greatest or largest diametrical extents are defined at the upper and lower surfaces of the tube support plate while the least or smallest diametrical extent is located at the axially central plane of the tube support plate. In this manner, it may be appreciated that each aperture, through-bore, hole, or the like defined within each tube support plate of the heat exchanger has, in effect, an hourglass configuration within which the water-steam generator tubes of the heat exchanger are of course to be accommodated.

As a result of the aforenoted hourglass configuration defined for each of the water-steam generator tube apertures, through-bores, holes, or the like, wherein the interior annular sidewall of the tube support plate is smoothly and continuously radiused from the upper surface of the tube support plate to the lower surface of the tube support plate, no sharp edges or land surfaces are present about which the water-steam generator tubes may be bent, or along which the tubes may be abrasively moved. In lieu of such relatively sharp, edge-contact surfaces of the tube support plate about which, or along which, the water-steam generator tubes may be relatively moved with respect to the tube support plates, the smoothly and continuously radiused interior wall surface of each aperture, through-bore, hole, or the like, defined within the tube support plates in accordance with the present invention, provides an extended surface contact area defined between the water-steam generator tubes and the tube support plate as opposed to substantially limited lineal or point contact areas defined between the water-steam generator tubes and the tube support plates as exemplified by conventional, prior art aperture, through-bore, or hole designs or configurations. Consequently, it may readily be appreciated that unacceptably excessive wear of the water-steam generator tubes, as a result of the abrasive movements of the tubes relative to the tube support plates, or vice-versa, can in fact be substantially eliminated or optimally minimized whereby the water-steam generator tubes can exhibit extended service lives within the heat exchanger. It is to be particularly noted that under operating conditions, should the water-steam generator tubes move relative to the tube support plates, or alternatively, should the tube support plates move relative to the water-steam generator tubes, the tubes can effectively be forced to smoothly pivot or rotate relative to the planes of the tube support plates by rotating about the centralmost, convex planar region defined within each of the tube support plates wherein the inner diametrical extent of the aperture, through-bore, hole, or the like, is smallest. In a corresponding manner, the pivoting or rotative movement of the tubes relative to the tube support plates is accommodated by the upper and lower surface portions of the tube support plates defining the tube apertures, through-bores, holes, or the like, in view of the fact that these portions are of greatest diametrical extent which, together with the centralmost axial regions of the tube support plates as well as the infinite axially located surfaces defined therebetween, define smoothly inclined or radially outwardly tapered surfaces as one proceeds from the centralmost plane of each tube support plate to the outer, upper and lower, planar surfaces thereof.

BRIEF DESCRIPTION OF THE DRAWINGS

Various other objects, features, and attendant advantages of the present invention will be more fully appreciated as the same becomes better understood from the following detailed description when considered in connection with the accompanying drawings, wherein:

THE SOLE FIGURE is a perspective view of a tube support plate and a water-steam generator tube passing therethrough, wherein such assembly may be utilized within a nuclear reactor power plant heat exchanger, and wherein further, in accordance with the present invention there is shown the new and improved aperture, through-bore, or hole design or configuration defined within the tube support plate and through which the water-steam generator tube passes in cooperation therewith whereby abrasive wear upon the water-steam generator tubes will be minimized or eliminated.

DESCRIPTION OF THE PREFERRED EMBODIMENT

Referring now to the drawings, there is shown in the SOLE FIGURE thereof the new and improved aperture, hole, or through-bore design or configuration defined within a tube support plate of, for example, a nuclear reactor steam generator heat exchanger, through which a water-steam generator tube passes with a minimized amount of developed abrasive wear during the service life thereof, as generally indicated by the reference character 10. In particular, while it may of course be appreciated that the new and improved aperture, through-bore, or hole design or configuration of the present invention may be applicable to, or capable of being utilized within, virtually any type of heat exchanger system, it is noted that the particular heat exchanger system in connection with which the present invention has been developed comprises a nuclear reactor steam generator heat exchanger.

As has been noted hereinbefore, in accordance with one type of exemplary nuclear reactor steam generator heat exchanger utilized within, for example, a liquid metal-cooled fast breeder reactor (LMFBR), the water-steam generator tubes 12, only one of which is shown, extend vertically between upper and lower heat exchanger tube sheets, not shown, with the ends of the water-steam generator tubes 12 fixedly secured therein and in fluidic communication with suitable water supply and discharge headers, also not shown. Interposed between the upper and lower tubesheets are a plurality of horizontally disposed tube support plates 14, only one of which is shown, which are suspendingly supported in a dependent mode from the upper tubesheet by means of stay rods, not shown, such that the tube support plates, in effect, hang freely from the upper tubesheet and are not connected to the lower or bottom tubesheet. Each of the tube support plates 14 is provided with a multitude of apertures, through-bores, holes, or the like, 16, only one of which is shown, through which the water-steam generator tubes 12 pass. In addition, the tube support plates 14 are provided with additional apertures or through-bores which permit the liquid sodium coolant to pass therethrough so as to be circulated through the heat exchanger in performance of its heat exchange process. It is to be noted at this juncture that the radius R1 of each of the water-steam generator tubes 12 is substantially less than the radius of the tube support plate apertures or through-bores 16, or in the case of the present invention, substantially less than the minimum radius R2 of the aperture or through-bore 16, and in this manner, the liquid sodium coolant can likewise pass through tube support plate apertures or through-bores 16 in accordance with its recirculatory flow mode through the heat exchanger.

In order to prevent the unacceptably excessive abrasive wear of the heat exchanger water-steam generator tubes 12 which are effectively confinedly housed within the apertures or through-bores 16 of the heat exchanger tube support plates 14, under operating conditions wherein either the water-steam generator tubes 12 may move transversely or pivotably with respect to the tube support plates 14 or the tube support plates 14 may move relative to the water-steam generator tubes 12, all as has been previously discussed hereinbefore, in accordance with the present invention, the interior annular sidewall portion 18 of each tube support plate defining each water-steam generator tube through-bore or aperture 16 is seen to be formed with a smoothly radiused curvature which is defined by means of an exterior radius R3 and which extends continuously from the upper planar surface 20 of the tube support plate 14 to the lower planar surface 22 of the tube support plate 14. In this manner, considered from another perspective, the through-bore or aperture 16 is seen to have an hourglass configuration with the minium radius R2 thereof being disposed at the centralmost axial plane of the through-bore or aperture 16 or tube support plate 14, while the maximum radii R4 thereof being located within the upper and lower surfaces 20 and 22 of the tube support plate 14.

As a result of the aforenoted hourglass configuration of each water-steam generator tube through-bore or aperture defined within each heat exchange tube support plate, it may be readily appreciated that no sharp edges, surfaces, or land areas are presented by means of each tube support plate 14 to each of the water-steam generator tubes 12 about which the tubes 12 would have to bend or be abrasively moved under various operating conditions within the heat exchanger. Considered from a different perspective, at various times, or under various conditions, during the operative modes of the nuclear reactor and the heat exchanger in particular, conventional water-steam generator tubes would be subjected to abrasive lineal contact with various structural portions of the tube support plate through-bore sidewall structures, however, in accordance with the present invention through means of the smoothly curved or radiused interior annular sidewall 18 of each tube support plate aperture 16, only smoothly arcuate surface contact is established or defined between the water-steam generator tubes 12 and each tube support plate 14. Consequently, it may readily be further appreciated that unacceptably excessive wear upon the water-steam generator tubes 12 by means of abrasive movement relative to the tube support plates 14, or as a result of movement of the tube support plates 14 relative to the tubes 12, has been effectively eliminated or substantially minimized whereby an extended service life is imparted to the water-steam generator tubes 12. This elimination or optimal minimization of the excessive wear upon the water-steam generator tubes 12 is seen to be the direct result of the radiused or curved configuration 18 of the through-bores or apertures 16 for it may be visualized that when there is relative movement established between the tubes 12 and the tube support plate 14, other than true co-axial movement defined therebetween, the tubes 12 will tend to rotate or pivot upon the extended radiused surface 18 of the aperture or through-bore 16 due to the centrally convex or curved portion thereof. This pivotal or rotational movement is also accommodated by means of the upper and lower portions of the through-bore or aperture 16 as defined by the radially enlarged upper and lower regions of bore or aperture 16 having suitable predetermined radial extent dimensional values R4 and which, together with the centralmost region of the bore or aperture 16, as defined by means of radial extent R2, as well as all of the remaining infinite regions disposed within transversely extending planes spaced axially along the axis of the bore or aperture 16, define smoothly inclined or radially outwardly tapered surfaces as one proceeds from the centralmost plane of each support plate 14 to the upper and lower surfaces, 20 and 22, thereof, respectively. It may thus be appreciated that significant wear characteristics and service life of the water-steam generator tubes 12 may be achieved in accordance with the tube plates 14 of the present invention having the particularly configured through-bores or apertures 16 defined therewithin to the effect that such apertures or through-bores 16 have continuously variable internal radial extents as determined by means of a constant-radiused external curvature R3.

Obviously, many modifications and variations of the present invention are possible in light of the above teachings. It is therefore to be understood that within the scope of the appended claims, the present invention may be practiced otherwise than as specifically described herein.

What is claimed is:

1. A heat exchanger, comprising:

a heat exchange tube, having a first diametrical extent, through which a first fluid is conducted in connection with a heat exchange process conducted within said heat exchanger; and a tube support plate having means defining a circumferentially continuous through-bore integrally within said tube support plate so as to extend from the upper surface of said tube support plate to the lower surface of said tube support plate for passage therethrough of said heat exchange tube, said through-bore having a second diametrical extent which is substantially greater than said first diametrical extent of said heat exchange tube so as to define a passageway between said heat exchange tube and the sidewalls of said tube support plate defining said through-bore for flow therethrough of a second fluid in connection with said heat exchange process conducted within said heat exchanger and which permits substantial axial, radial, and angular relative movements between said heat exchange tube and said tube support plate, said through-bore furthermore having an hour-glass shaped configuartion defined between said upper and lower surfaces of said tube support plate so as to substantially reduce and eliminate excessive wear upon said heat exchange tube as a result of said axial, radial, and angular relative movements being experienced between said heat exchange tube and said tube support plate.

2. A heat exchanger, comprising:

a heat exchange tube, having a first diametrical extent, through which a first fluid is conducted in connection with a heat exchange process conducted within said heat exchanger; and a tube support plate having means defining a circumferentially continuous through-bore integrally within said tube support plate so as to extend from the upper surface of said tube support plate to the lower surface of said tube support plate for passage therethrough of said heat exchange tube, said through-bore having a second diametrical extent which is substantially greater than said first diametrical extent of said heat exchange tube so as to define a passageway between said heat exchange tube and the sidewalls of said tube support plate defining said through-bore for flow therethrough of a second fluid in connection with said heat exchange process conducted within said heat exchanger and which permits substantial axial, radial, and angular relative movements between said heat exchange tube and said tube support plate, said through-bore furthermore having an internal annular sidewall which is continuously arcuate from said upper surface of said tube support plate to the lower surface of said tube support plate, as defined by means of a predetermined radius externally of said through-bore, so as to substantially reduce and eliminate excessive wear upon said heat exchange tube as a result of said axial, radial, and angular relative movements being experienced between said heat exchange tube and said tube support plate.

3. A heat exchanger, comprising:

a heat exchange tube, having a first diametrical extent, through which a first fluid is conducted in connection with a heat exchange process conducted within said heat exchanger; and a tube support plate having means defining a circumferentially continuous through-bore integrally within said tube support plate so as to extend from the upper surface of said tube support plate to the lower surface of said tube support plate for passage therethrough of said heat exchange tube, said through-bore having a second diametrical extent which is substantially greater than said first diametrical extent of said heat exchange tube so as to define a passageway between said heat exchange tube and the sidewalls of said tube support plate defining said through-bore for flow therethrough of a second fluid in connection with said heat exchange process conducted within said heat exchanger and which permits substantial axial, radial, and angular relative movements between said heat exchange tube and said tube support plate, said through-bore furthermore having an internal annular sidewall which is smoothly radiused from said upper surface of said tube support plate to said lower surface of said tube support plate, such that a radially inwardly convex portion is defined between said upper and lower surfaces of said tube support plate, so as to substantially reduce and eliminate excessive wear upon said heat exchange tube as a result of said axial, radial, and angular relative movements being experienced between said heat exchange tube and said tube support plate.

4. A heat exchanger as set forth in claim 1, wherein: said hourglass shaped through-bore is defined by means of constantly changing radial dimensions as one proceeds along the axis of said through-bore.

5. A heat exchanger as set forth in claim 1, wherein: said hourglass shaped through-bore is defined by means of a predetermined radius external to said through-bore.

6. A heat exchanger as set forth in claim 1, wherein: said hourglass shaped through-bore comprises an internal annular sidewall which has a radially inwardly convex portion defined between said upper and lower surfaces of said tube support plate.

7. A heat exchanger as set forth in claim 1, wherein: said heat exchange tube is a water-steam generator tube disposed within a steam generator heat exchanger.

8. A heat exchanger as set forth in claim 1, wherein: said heat exchanger is a nuclear reactor steam generator heat exchanger.

9. A heat exchanger as set forth in claim 2, wherein: said internal annular sidewall comprises a radially inwardly convex portion defined between said upper and lower surfaces of said tube support plate.

10. A heat exchanger as set forth in claim 2, wherein: said internal annular sidewall of said through-bore is defined by means of constantly changing radial dimensions as one proceeds along the axis of said through-bore.

11. A heat exchanger as set forth in claim 4, wherein: said constantly changing radial dimensions of said through-bore are greatest within the upper and lower surface planes of said tube support plate, and is minimized at the central plane of said tube support plate.

12. A heat exchanger as set forth in claim 10, wherein: said constantly changing radial dimensions of said through-bore are of a maximum value within the planes of said upper and lower surfaces of said tube support plate, and of a minimum value within the central plane of said tube support plate.

13. A heat exchanger as set forth in claim 2, wherein: said heat exchange tube is a water-steam generator tube disposed within a steam generator heat exchanger.

14. A heat exchanger as set forth in claim 2, wherein: said heat exchanger is a nuclear reactor steam generator heat exchanger.

15. A heat exchanger as set forth in claim 2, wherein: said through-bore has an hourglass configuration.

16. A heat exchanger as set forth in claim 3, wherein: said through-bore has an hourglass configuration.

17. A heat exchanger as set forth in claim 3, wherein: said smoothly radiused internal annular sidewall of said through-bore is defined by means of a predetermined radius external of said through-bore.

18. A heat exchanger as set forth in claim 3, wherein: said internal annular sidewall of said through-bore is defined by means of constantly changing radial dimensions as one proceeds along the axis of said through-bore.

19. A heat exchanger as set forth in claim 18, wherein: said constantly changing radial dimensions of said through-bore are greatest within the upper and lower surface planes of said tube support plate, and is minimized at the central plane of said tube support plate.

* * * * *